US006793372B2

(12) United States Patent
Wehner et al.

(10) Patent No.: US 6,793,372 B2
(45) Date of Patent: Sep. 21, 2004

(54) MULTIPLE REFLECTOR INDIRECT LIGHT SOURCE LAMP

(75) Inventors: Kathryn M. Wehner, Carmel, IN (US); David L. Rhorer, Anderson, IN (US)

(73) Assignee: Guide Corporation, Pendleton, IN (US)

( * ) Notice: Subject to any disclaimer, the term of this patent is extended or adjusted under 35 U.S.C. 154(b) by 0 days.

(21) Appl. No.: 10/232,666

(22) Filed: Sep. 3, 2002

(65) Prior Publication Data

US 2004/0042209 A1 Mar. 4, 2004

(51) Int. Cl.[7] ..... F21V 7/00

(52) U.S. Cl. ..... 362/247; 362/517; 362/547; 362/421; 362/297; 362/346; 362/347; 362/373; 362/800

(58) Field of Search ..... 362/247, 459, 362/485, 487, 498, 499, 516, 517, 519, 547, 227, 241, 296, 297, 304, 341, 346, 347, 373, 800

(56) References Cited

U.S. PATENT DOCUMENTS

| | | | | | |
|---|---|---|---|---|---|
| 1,148,101 | A | * | 7/1915 | Kush | 362/247 |
| 1,626,983 | A | * | 5/1927 | Sullivan | 362/519 |
| 2,740,104 | A | * | 3/1956 | Nallinger | 362/243 |
| 2,755,374 | A | * | 7/1956 | Ott et al. | 362/247 |
| 3,679,893 | A | | 7/1972 | Shemitz et al. | |
| 3,725,693 | A | | 4/1973 | Anderson et al. | |
| 4,032,769 | A | | 6/1977 | Hartman et al. | |
| 4,047,015 | A | | 9/1977 | Blount | |
| 4,164,007 | A | | 8/1979 | Audesse et al. | |
| 4,494,176 | A | | 1/1985 | Sands et al. | |
| 4,628,422 | A | * | 12/1986 | Ewald | 362/240 |
| 4,680,679 | A | | 7/1987 | Dilouya | |
| 4,935,665 | A | | 6/1990 | Murata | |
| 4,963,933 | A | | 10/1990 | Brownlee | |
| 5,060,120 | A | | 10/1991 | Kobayashi et al. | |
| 5,117,336 | A | | 5/1992 | Scenzi | |
| 5,373,430 | A | | 12/1994 | McDermott | |
| 5,394,310 | A | | 2/1995 | Iwasaki | |
| 5,418,420 | A | | 5/1995 | Roberts | |
| 5,782,553 | A | | 7/1998 | McDermott | |
| 6,467,927 | B1 | * | 10/2002 | Haugaard et al. | 362/147 |
| 2001/0010635 | A1 | * | 8/2001 | Gotou | 362/517 |

FOREIGN PATENT DOCUMENTS

| | | |
|---|---|---|
| EP | 0 200 629 A1 | 12/1986 |
| FR | 1 571 960 | 7/1980 |

* cited by examiner

*Primary Examiner*—Stephen Husar
*Assistant Examiner*—Sharon Payne
(74) *Attorney, Agent, or Firm*—Ice Miller; Jay G. Taylor

(57) ABSTRACT

The present invention comprises a light assembly with LESDs mounted opposite to the reflective side of a reflector. A plurality of reflectors are arranged in an overlapping fashion such that the light emitted from the LESD of one reflector is directed to the reflective surface of an underlying reflector. In this fashion, a number of LESDs may be incorporated into a lighting device in a variety of patterns while maintaining the LESDs and their mountings hidden from view.

21 Claims, 6 Drawing Sheets

MULTIPLE REFLECTOR INDIRECT LIGHT SOURCE LAMP

BACKGROUND OF THE INVENTION

This invention relates generally to automotive lighting systems and, in particular, to an automotive lamp with multiple reflectors and multiple light sources.

Generally, conventional automotive lighting systems utilize filament bulbs as a lighting source. However, filament bulbs have many drawbacks, including high consumption of electrical power, the generation of great amounts of heat, and readily breakable filaments. Recently, due to these drawbacks, light emitting semiconductor devices (LESDs), such as light emitting diodes ("LEDs"), have been adapted for use in certain automobile lighting systems.

LEDs solve many of the problems associated with filament bulbs, because they emit light using a lower voltage and current than used by a filament bulb and are less prone to breakage. However, various other problems are associated with LEDs when used in automobile lighting systems. For example, an individual LED is limited in its forward lighting power, because the low voltage associated with LEDs results in less lighting power than a filament lamp. Moreover, LEDs use a substantially planar luminescent element which radiates high intensity light predominantly in the forward direction, and only minimal light energy is emitted toward the sides. Thus, parabolic reflectors are typically not as useful in increasing the amount of light directed in the axis of the reflector.

Accordingly, an LED's lighting power must be augmented when it is used in an automobile lighting system, such as a headlamp or a tail light. A headlamp requires that there be enough forward lighting power to illuminate the road and to meet the governmental restrictions placed on headlamps regarding the placement, brightness, and photometrics for such lamps. Further, LEDs used in tail lights are required to have enough lighting power to call attention to vehicles that the car ahead of them is stopping, in accordance with government regulations.

In order to augment the light emitted from a device comprising LEDs, it is generally necessary to combine a plurality of LED lamps into a single lighting device. The problem that has arisen with this solution is that of finding a way to combine a plurality of LEDs into a single lighting device of limited size, which is still capable of making a concentrated light beam that meets the specific intensity, beam spread, power consumption and size requirements of the industry. For example, the combination of two or more separate LED lamps within a single parabolic reflector as a means to increase the emitted light intensity results in projection of multiple separate beams with dark intermediate zones. This is not acceptable in a vehicle headlamp.

A second potential solution includes the use of multiple LEDs, each LED having its own reflector. This solution has not been acceptable in the past because the overall size limitation for the lighting device forces each individual reflector to be reduced in size, resulting in projected beams with unacceptably large individual divergences. Moreover, as the number of LEDs is increased, the amount of heat generated by the LEDs increases. Therefore, due to the size limitations on an automotive lighting system device, a need exists for an automotive lighting system that efficiently combines a plurality of LEDs into a single, compact lighting device while providing for dissipation or removal of excess heat generated by the lighting system.

One approach to solving the problem of light intensity is found in U.S. Pat. No. 5,782,553 to McDermott ("the '553 patent"). The '553 patent discloses the use of a concave reflector to collect and concentrate light from a plurality of light sources. According to the '553 patent, the light sources are embedded into various quadrants of a transparent medium such that emitted light passes through the medium and reflects off of a single concave reflector at the rear of the quadrants of the medium. The reflected light then passes back through the medium and finally exits the medium as a single beam of light. Accordingly, great care is needed in selecting an appropriate medium, as poor transmissivity of the medium will deleteriously affect the ultimate goal of increased light intensity. Notwithstanding the care taken in selecting the transparent medium, the '553 patent contemplates significant transmission losses (up to 25%) in practicing the invention therein. It would be beneficial to obtain the benefit of multiple light sources without incurring the transmission losses as contemplated by the '553 patent.

Another approach is disclosed in U.S. Pat. No. 6,412,971 B1 to Wojnarowski et al. ("the '971 patent"). The '971 patent discloses a substrate upon which a number of LESDs are arranged. According to the '971 patent, reflector components may be used in conjunction with the LESDs, much in the same way that reflector components are used with a filament bulb. Specifically, the reflector components extend upwardly and outwardly from the surface of the LESDs or the base of the LESDs if it is desired to reflect light emitted from the sides of the LESDs. In either application, however, the LESDs and their mountings are directly viewable. It would be advantageous, if the light source and its mounting were hidden from view so as to be more aesthetically pleasing.

It is desirable, therefore, to provide a multiple light source without incurring excessive transmission losses. Moreover, it is desired that the light assembly present an aesthetically pleasing form. It would be further advantageous if the light assembly could be formed into a variety of shapes and patterns. It would also be advantageous if the light assembly provided for dissipation of heat generated by the light source.

BRIEF SUMMARY OF THE INVENTION

In accordance with the present invention, a light assembly is provided which overcomes the disadvantages of the prior art. According to the present invention, LESDs are mounted opposite to the reflective side of a reflector. A plurality of reflectors are arranged in an overlapping fashion such that the light emitted from the LESD of one reflector is directed to the reflective surface of an underlying reflector. In this fashion, a number of LESDs may be incorporated into a lighting device in a variety of patterns while maintaining the LESDs and their mountings hidden from view. Moreover, the reflectors may be used as cooling fins to dissipate heat generated from the LESDs or to direct the heat to a heat sink.

The invention provides a light assembly which may include a number of light sources without incurring excessive transmission losses. Moreover, the light assembly presents an aesthetically pleasing form since the light sources and their mountings are hidden from view. Additionally, the light assembly may be constructed in a variety of patterns. Moreover, the light assembly may easily be configured to dissipate heat generated from the LESDs or to direct the heat to a heat sink.

DETAILED DESCRIPTION OF THE INVENTION

Figure 1:
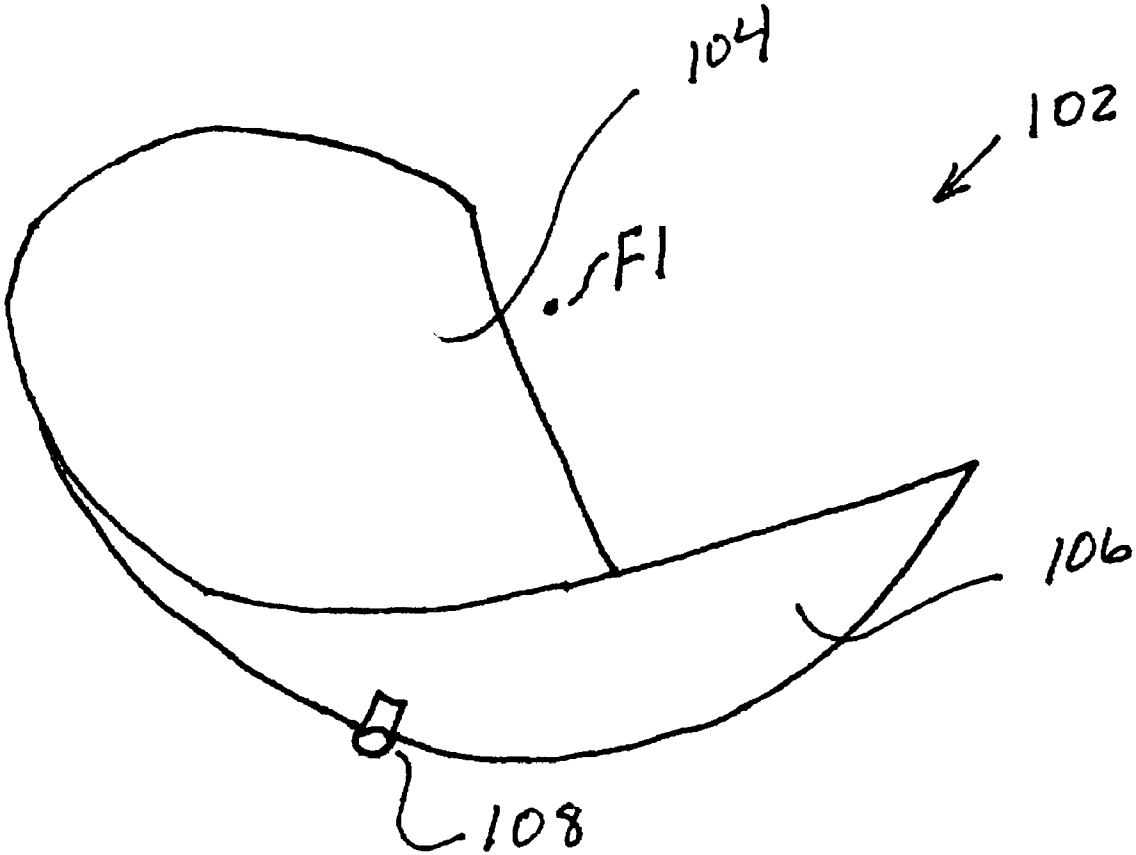
FIG. 1 is a perspective view of a reflector and light source in accordance with an exemplary embodiment of the present invention.

FIG. 1 is a perspective view of an exemplary embodiment of a reflector for use in a lamp assembly in accordance with the present invention. Although reflector 102 in this embodiment comprises a parabolic reflector formed into a generally elliptical shape, the present invention includes within its scope the use of other shapes of reflectors. For example, in applications wherein collimation of light rays is not desired, a generally flat or convex reflector may be used. As will be understood by those of skill in the art, when used with LEDs it may be preferred to use a concave shape, such as, but limited to, a generally parabolic shape, in order to better focus or even collimate light rays from the light source. Reflector 102 comprises reflecting side 104 and opposite side 106. Light source 108 is shown arranged upon opposite side 106. Focal point F1 of reflector 102 is located outwardly of reflecting side 104. Focal point F1 is a function of the prescription of reflector 102.

Light source 108 in this embodiment comprises an LED. When using an LED, power may be supplied by a number of means well known in the art. For example, a conductive grid may be established upon opposite side 106. Alternatively, the material used to give reflectance to reflective side 104 may be used to provide electric coupling. This may be accomplished in a number of ways. For example, if a reflective layer of material is applied to a substrate, the material may be extended through the substrate at specific locations so as to provide power through the substrate to the surface of opposite side 106. Alternatively, reflector 102, including opposite side 106, may comprise a conductive material. In this alternative example, the LED may be directly connected at one terminal to opposite side 106 such as by solder or conductive adhesive, and an insulated line provided at the other terminal of the LED for electric coupling. These alternative methods of providing power and others are within the scope of the present invention. Moreover, those of skill in the art will recognize that the present invention may be practiced with a variety of different light sources including, but not limited to, LESDs and filament light bulbs.

Figure 2:
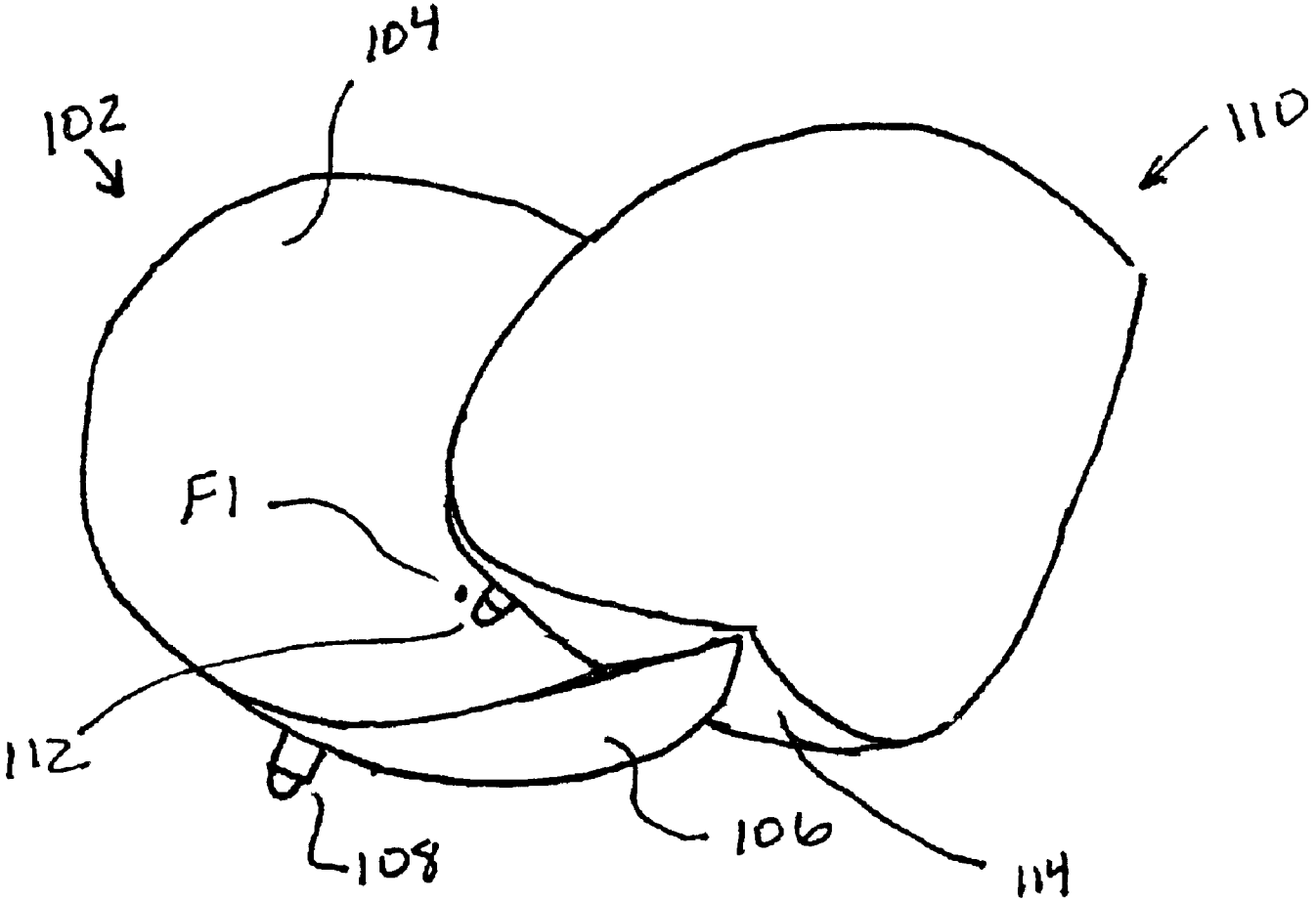
FIG. 2 is a perspective view of two nested reflectors in accordance with an exemplary embodiment of the present invention.

According to one embodiment of the invention, reflectors in accordance with the present invention are arranged in a radial pattern with each one overlapping the next in such a manner so as to hide the focal point of the reflectors from direct view (in front of the lamp). This is shown in FIG. 2, where reflector 110 has been arranged such that light source 112, which is arranged on opposite side 114 of reflector 110, is located substantially at focal point F1 of reflector 102.

Figure 3:
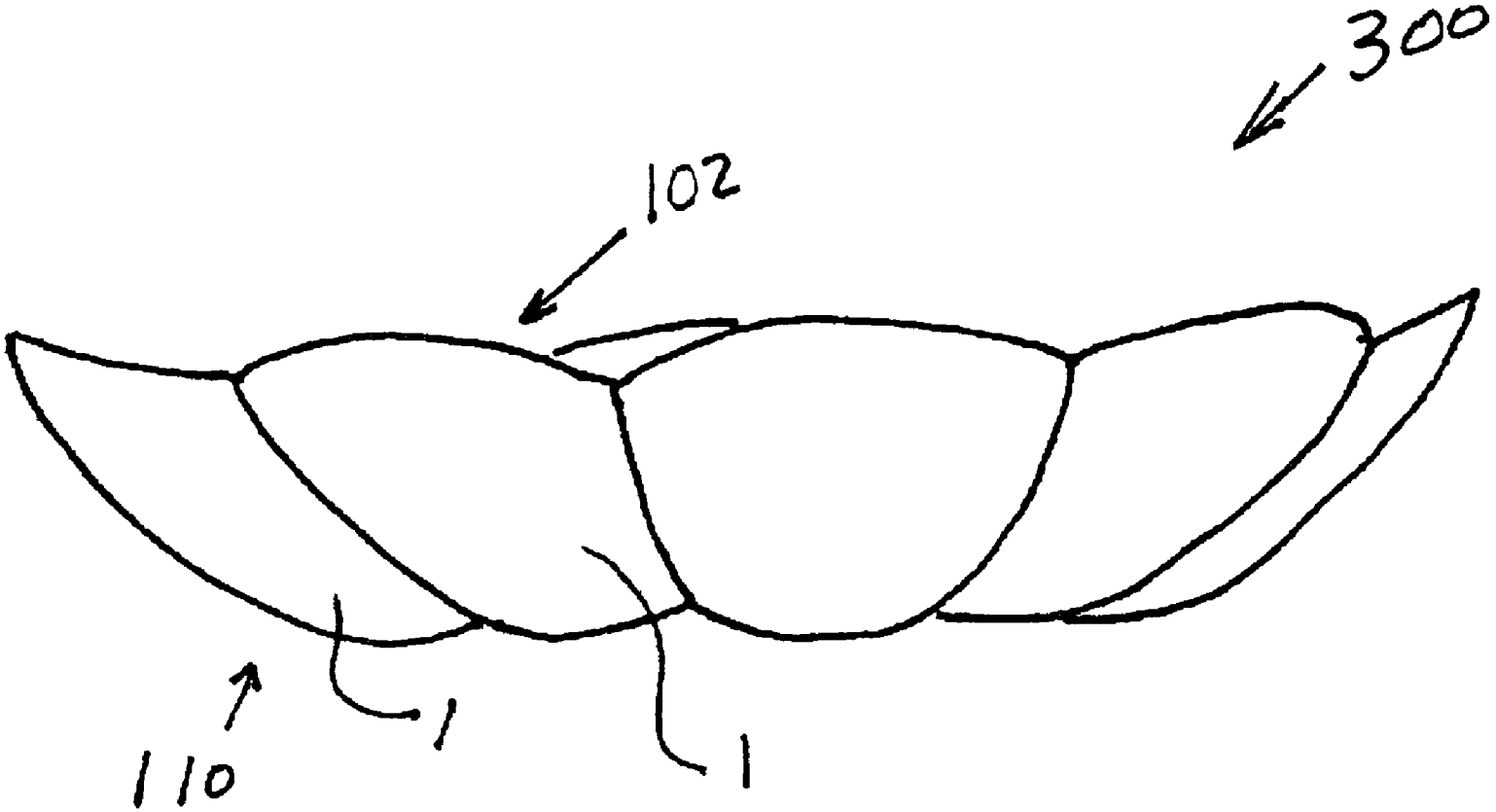
FIG. 3 is a perspective side view of an exemplary embodiment of the present invention.

FIG. 3 shows a side plan view of light assembly 300 which comprises a number of reflectors arranged in a radial, nested fashion, with each reflector overlapping the next. Even though opposite side 114 of reflector 110 is shown from this perspective, light source 112 is not visible, as opposite side 106 of reflector 102 conceals light source 112.

Figure 4:
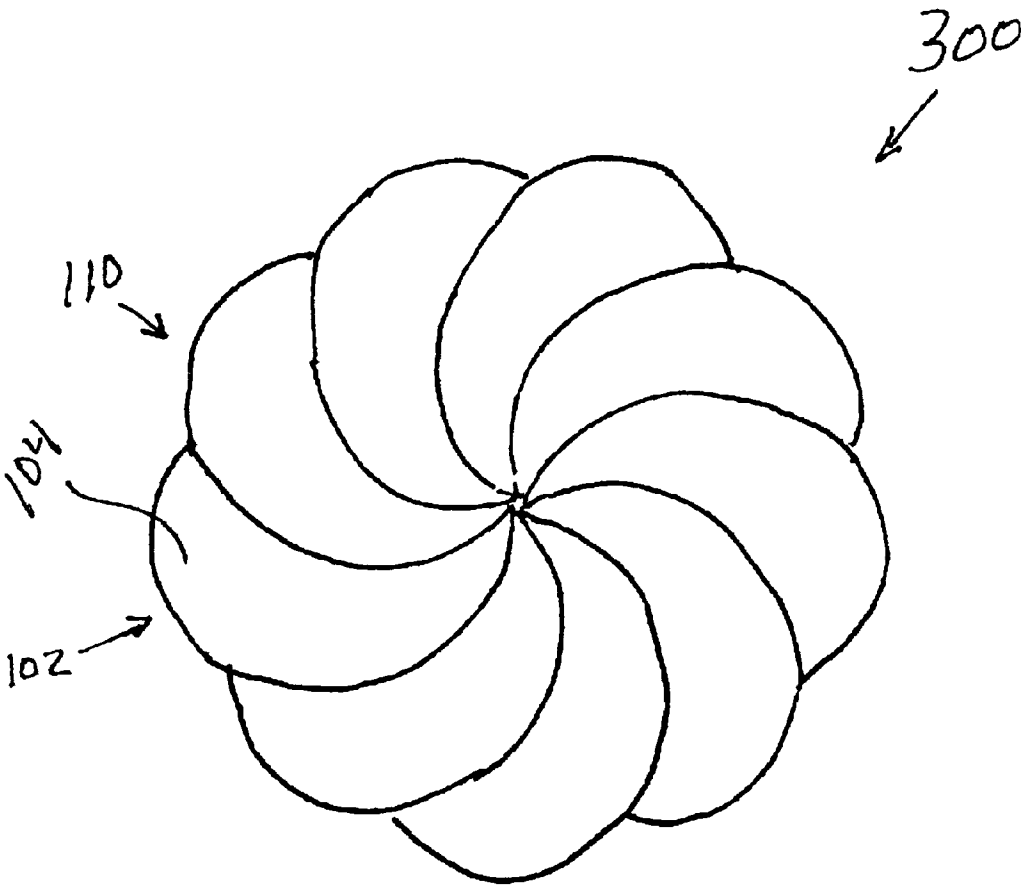
FIG. 4 is a schematic top plan view of a vehicle lighting assembly in accordance with an exemplary embodiment of the present invention.

Referring now to FIG. 4, a front plan view of light assembly 300 is shown. From this perspective, light source 108 is hidden from view by reflecting side 104. Similarly, the light sources on the other reflectors are not visible from this perspective, since only the reflecting sides of the reflectors are visible.

Figure 5:
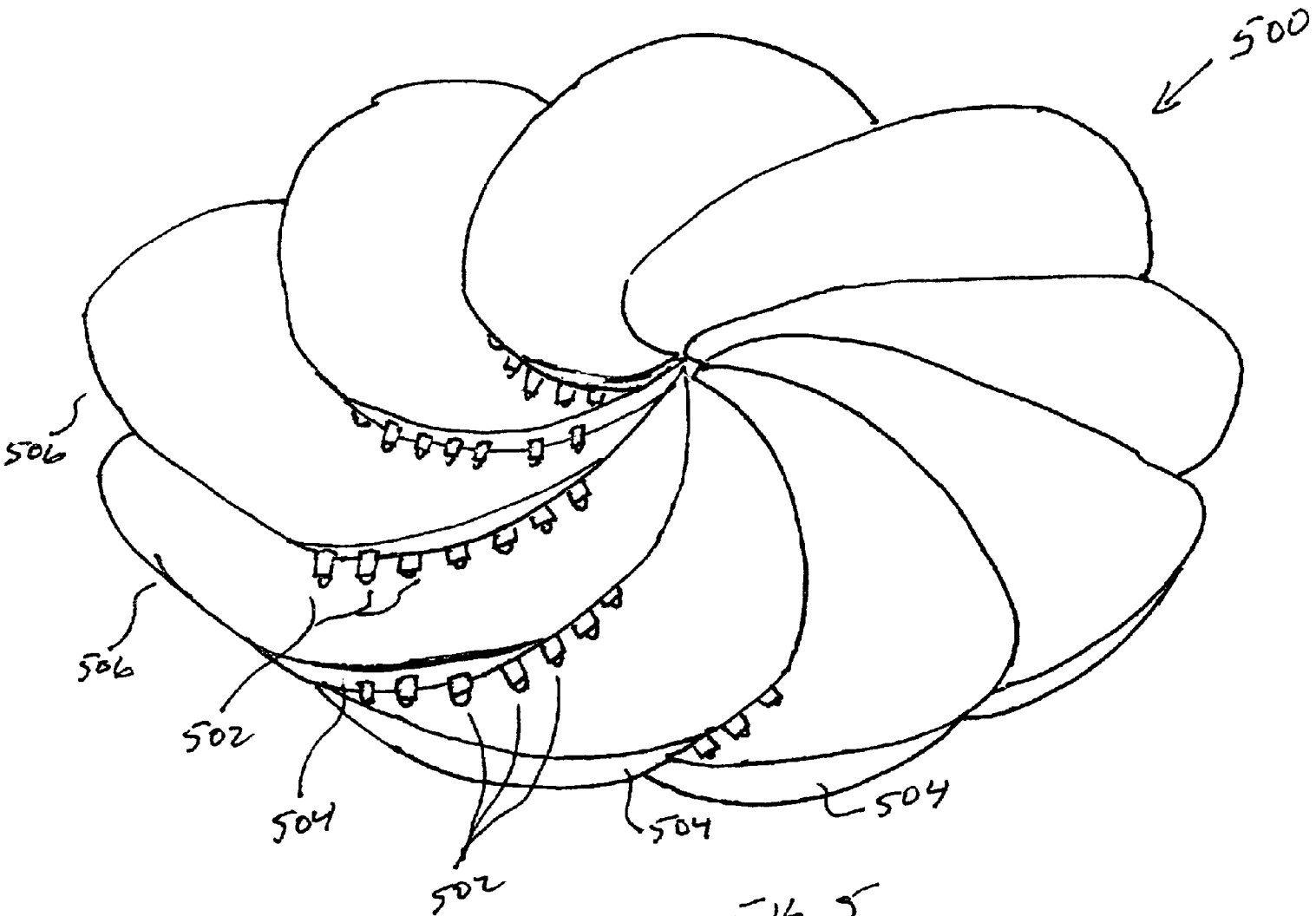
FIG. 5 is a perspective view of an alternative embodiment of the present invention.

According to an alternative embodiment, a plurality of light sources may be used. This is shown in FIG. 5, which is a perspective view of light assembly 500. Light sources 502 are mounted on opposite sides 504 of reflectors 506. When using a number of light sources, it is contemplated that the shape of the reflectors 506 will be modified so as to optimize the light reflected. Light sources 502 are visible in FIG. 5 because of the perspective angle shown. When light assembly 500 is viewed from the direction of the reflected beam, light sources 502 are not visible.

Those of skill in the art will recognize that as the number of light sources increases, the amount of energy generated by the combined light sources also increases. According to one embodiment of the present invention, reflectors 506 comprise a thermally conductive material. Thus, a heat sink or coolant device may be thermally coupled to reflectors 506 so as to eliminate excess heat.

Figure 7:
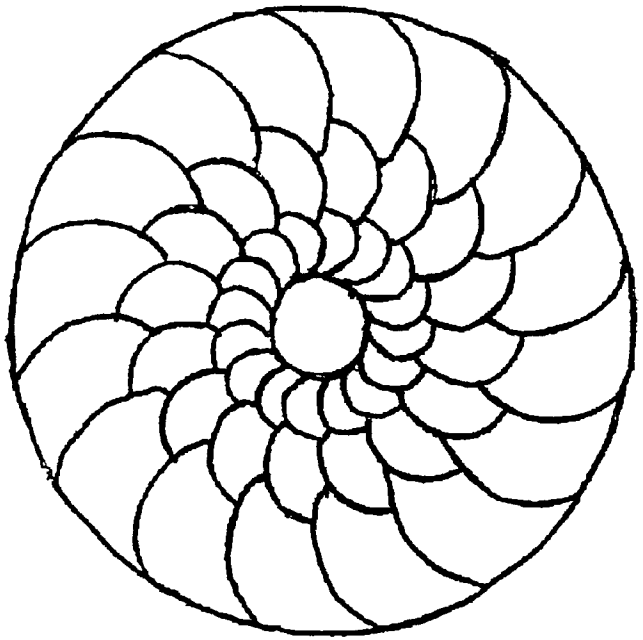
FIG. 7 is a schematic top plan view of an alternative vehicle lighting assembly in a multiple circle design in accordance with an exemplary embodiment of the present invention.
Figure 6:
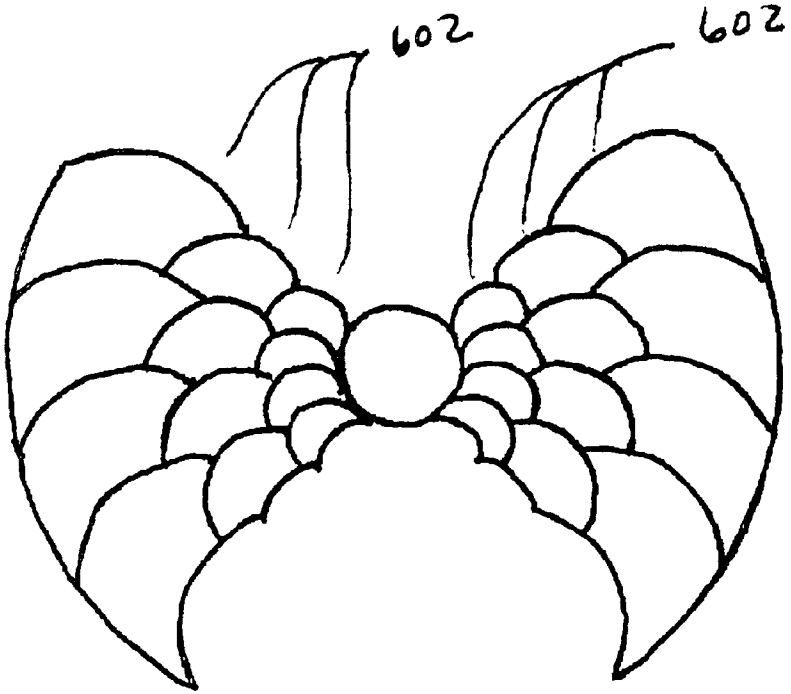
FIG. 6 is a schematic top plan view of an alternative vehicle lighting assembly in a wing design in accordance with an exemplary embodiment of the present invention.

Those of skill in the art will recognize that in accordance with the present invention, the shape of the reflectors and the overall shape of the lamp could be varied to generate a variety of unique appearances, provided that the optical and photometric requirements of the lamp are still satisfactory. One such appearance is shown in FIG. 6. In the embodiment of FIG. 6, all reflectors 602 need not have light sources arranged upon the side opposite the reflecting side. Yet another example of a unique appearance is shown in FIG. 7, wherein reflectors of varying sizes are incorporated into a circular design. Depending on the desired design, it may be useful to incorporate reflectors of various prescriptions, thus allowing for variation in the spacing between the reflectors while maintaining the light source of the overlapping reflector to be substantially at the focal point of the underlying reflector.

Those of skill in the art will realize that as described herein, the present invention provides significant advantages over the prior art. The invention provides a light assembly which may include a number of light sources without incurring excessive transmission losses. Moreover, the light assembly presents an aesthetically pleasing form since the light sources and their mountings are hidden from view. Additionally, the light assembly may be constructed in a variety of patterns. Moreover, the light assembly may easily be configured to dissipate heat generated from the LESDs or to direct the heat to a heat sink.

While the present invention has been described in detail with reference to certain exemplary embodiments thereof, such are offered by way of non-limiting example of the invention, as other versions are possible. It is anticipated that a variety of other modifications and changes will be apparent to those having ordinary skill in the art and that such modifications and changes are intended to be encompassed within the spirit and scope of the invention as defined by the following claims.

We claim:

1. A lamp assembly, comprising:

a plurality of reflectors each having a reflecting side and a side opposite the reflecting side; and a light emitting source mounted upon the side opposite the reflecting side of each of the plurality of reflectors;

the plurality of reflectors being arranged such that each light emitting source emits light onto the reflecting side of an adjacent one of the plurality of reflectors.

2. The lamp assembly of claim 1, wherein the reflecting side of the reflector comprises a concave reflector.

3. The lamp assembly of claim 2, wherein the reflecting side of the reflector comprises a generally parabolic reflector.

4. The lamp assembly of claim 1, further comprising a means for dissipating heat generated by the lamp assembly.

5. The lamp assembly of claim 4, wherein the means for dissipating heat comprises at least one of the plurality of reflectors.

6. The lamp assembly of claim 1, wherein the reflecting sides of the plurality of reflectors are formed in generally concave shapes such that the reflecting sides of the plurality of reflectors have prescriptions defining focal points, and wherein the light emitting source mounted to each of the plurality of reflectors is located proximate to a focal point of a reflecting side of an adjacent one of the plurality of reflectors.

7. The lamp assembly of claim 6, wherein the light emitting source comprises a light emitting semiconductor device.

8. The lamp assembly of claim 7 wherein the light emitting semiconductor device comprises an LED.

9. The lamp assembly of claim 6, wherein the light emitting source comprises a filament bulb.

10. The lamp assembly of claim 6, wherein the plurality of reflectors comprises two or more reflectors having the same prescription.

11. The lamp assembly of claim 6, wherein the plurality of reflectors comprises at least one reflector having a prescription that is not the same as at least one other reflector of the overlapping reflectors.

12. A method of manufacturing a lamp assembly, comprising the steps of:

forming a a plurality of reflectors each having a reflecting side and a side opposite the reflecting side;

mounting upon the side opposite the reflecting side of each of the plurality of reflectors a light emitting source;

arranging the plurality of reflectors in an overlapping design such that the light emitting source mounted on each of the plurality of reflectors emits light onto the reflecting side of an adjacent one of the plurality of reflectors.

13. The method of claim 12, wherein the step of forming a reflector comprises the step of forming a reflector having a concave shape.

14. The method of claim 13, wherein the step of forming a reflector comprises the step of forming a reflector having a generally parabolic shape.

15. The method of claim 12, further comprising the step of forming a means for dissipating heat generated by the lamp assembly.

16. The method of claim 15, wherein the step of forming a reflector comprises the step of forming a means for dissipating heat.

17. The method of claim 12, wherein the step of forming a plurality of reflectors comprises the step of forming a plurality of reflectors in generally concave shapes such that the reflecting sides of the plurality of reflectors have prescriptions defining focal points, and wherein the step of arranging the plurality of reflectors comprises the step of positioning the plurality of reflectors such that the light emitting source of each of the plurality of reflectors is located proximate to a focal point of a reflecting side of an adjacent one of the plurality of reflectors.

18. The method of claim 12, wherein the step of mounting upon the side opposite the reflecting side of the plurality of reflectors a light emitting source comprises the step of mounting an LED upon the side opposite the reflecting side of the plurality of reflectors.

19. The method of claim 12 wherein the step of mounting upon the side opposite the reflecting side of the plurality of reflectors a light emitting source comprises the step of mounting a filament bulb upon the side opposite the reflecting side of the plurality of reflectors.

20. The method of claim 17, wherein the step of forming a plurality of reflectors comprises the steps of:

forming a first reflector with a prescription; and forming a second reflector with the same prescription as the first reflector.

21. The method of claim 17, wherein the step of forming a plurality of reflectors comprises the steps of:

forming a first reflector with a prescription; and forming a second reflector with a prescription different from the first reflector.

* * * * *